US007617936B2

(12) United States Patent
Barnett, Jr.

(10) Patent No.: US 7,617,936 B2
(45) Date of Patent: Nov. 17, 2009

(54) PORTABLE DISPLAY CONTAINER FOR HAIR CLIPPERS

(76) Inventor: Walter T. Barnett, Jr., 4304 Brinkley Rd., Temple Hills, MD (US) 20748

( * ) Notice: Subject to any disclaimer, the term of this patent is extended or adjusted under 35 U.S.C. 154(b) by 0 days.

(21) Appl. No.: 12/187,512

(22) Filed: Aug. 7, 2008

(65) Prior Publication Data

US 2008/0289983 A1 Nov. 27, 2008

Related U.S. Application Data

(63) Continuation of application No. 11/261,566, filed on Oct. 31, 2005, now abandoned.

(51) Int. Cl.
*B65D 85/00* (2006.01)

(52) U.S. Cl. ..... 206/576; 206/702; 206/722

(58) Field of Classification Search ..... 206/576, 206/320, 349, 351, 372, 775, 779, 701, 702, 206/722, 723

See application file for complete search history.

(56) References Cited

U.S. PATENT DOCUMENTS

| | | | | |
|---|---|---|---|---|
| 2,763,707 | A | 9/1956 | Soderberg | |
| 4,159,773 | A | 7/1979 | Losenno | |
| 4,303,156 | A | 12/1981 | Vucich | |
| 4,723,657 | A | 2/1988 | Robinson | |
| 4,871,074 | A | 10/1989 | Bryson et al. | |
| 5,379,903 | A | 1/1995 | Smith | |
| 5,531,333 | A | 7/1996 | Vara | |
| 5,638,955 | A * | 6/1997 | Calciano | 206/320 |
| 5,727,745 | A | 3/1998 | Vara | |
| 5,794,799 | A * | 8/1998 | Collins et al. | 211/70.6 |
| 5,924,579 | A | 7/1999 | DuPont et al. | |
| 6,003,804 | A | 12/1999 | Vara | |
| D435,185 | S | 12/2000 | Winchester | |
| 6,164,582 | A | 12/2000 | Vara | |
| 6,386,377 | B1 * | 5/2002 | Yeoman | 211/60.1 |
| 6,966,791 | B1 | 11/2005 | Farr | |
| 6,968,955 | B2 | 11/2005 | Steeber | |
| 2005/0224305 | A1 | 10/2005 | Davis | |

* cited by examiner

*Primary Examiner*—Jacob K Ackun, Jr.
(74) *Attorney, Agent, or Firm*—Edell, Shapiro & Finnan, LLC

(57) ABSTRACT

A case for receiving and retaining a plurality of barbers' hair clippers has a flat bottom with raised peripheral walls, a section of which has an array of notches defined in its upper edge to receive and engage electric cords extending beyond the case to connect to wall sockets. The clippers are retained side-by-side in one compartment separated by partitions from other compartments containing other barber's accessories. A lid is pivotably attached to the case to close the case during transport of the retained items. The lid has a mirror on its interior surface and is selectively removable from the case. The clippers are retained in sufficiently spaced relation to permit the cords to be folded or coiled and stored in the clipper compartment during transport.

21 Claims, 6 Drawing Sheets

PORTABLE DISPLAY CONTAINER FOR HAIR CLIPPERS

CROSS REFERENCE TO RELATED APPLICATIONS

This application is a continuation of U.S. Nonprovisional application Ser. No. 11/261,566, filed 31 Oct. 2005 and entitled "Portable Display Container for Hair Clippers", the disclosures of which is hereby incorporated by reference in its entirety.

BACKGROUND OF THE INVENTION

1. Field of the Invention

The present invention pertains to a portable case for receiving and retaining electric hair clippers and other barber's accessories ordinarily used in barber shops and, in particular, to a case for receiving and retaining a plurality of electric hair clippers in a readily accessible position by a barber for intermittent use during hair cutting and then storage and transport, as required.

2. Discussion of the Related Art

It is common for barbers to utilize two or more sizes of electric hair clippers during hair cutting and, when an electric hair clipper is not being used, the hair clipper is typically laid on a counter adjacent the barber's chair. Movement of the barber about the chair during hair cutting may inadvertently snag the electric cord of the hair clipper which often partially hangs off the counter, thereby pulling the hair clipper off of the counter to fall to the floor. Moreover, a barber may not properly place the hair clipper onto the counter during hair cutting, whereby the hair clipper may fall or slide off of the counter as it is pulled by the weight of its own electric cord hanging off the counter. The hair cutting teeth of the hair clipper are somewhat fragile and can easily be broken in such a fall and, to the detriment of the barber, such a damaged hair clipper is extremely expensive to repair or replace.

A conventional solution for safeguarding against the accidental dropping of electric hair clippers is the attachment of a loop to the end of the hair clipper in proximity to where the electric cord extends from the hair clipper, referred to herein as the "bottom" of the hair clipper. A corresponding hook is attached to the edge or side wall of the counter adjacent the workspace of the barber so that the hair clipper may be hung in an "upside down" position along the side of the counter. Once the hair clipper is placed in a position wherein the hook extends through the loop, the hair clipper is relatively secure against inadvertently falling. U.S. Pat. No. 4,159,773 (Losenno) teaches this conventional solution in the field of beautician's tools such as hair dryers and curling irons.

An improvement to this "hanging" approach is disclosed in U.S. Pat. No. 5,379,903 (Smith) wherein the electric cord of each hair clipper is retracted into a box against which the hair clippers hang bottom-up in an upside down position. A disadvantage to the conventional solution, even when refined as disclosed in Smith, is that the electric cord of a hair clipper tends to extend below the hair clipper in the retained upside down position, causing the electric cord to bend or curve a full 180° after immediately extending from the hair clipper. This curvature places a large stress on the connection of the electric cord with the hair clipper and results in the electric cord developing a short circuit before the full life expectancy of the hair clipper otherwise enjoyed is fully realized.

A second disadvantage to the conventional solution is that the electric hair clipper is only relatively secure when the hook is extended through the loop. Thus, if the hair clipper slides from the barber's grasp while he/she attempts to place the loop over the hook, or if the barber prematurely releases the hair clipper believing that the loop and hook have engaged, the hair clipper will once again be dropped and subject to breaking.

Prior art approaches aimed at solving these problems are disclosed in U.S. Pat. Nos. 4,871,074 (Bryson et al), 5,379,903 (Smith), 5,924,579 (DuPont et al) and Des. 435,185 (Winchester). These patents all disclose a rack of some sort in which a plurality of clippers may be placed to either hang or be lain in a manner that minimizes the danger of a clipper falling to the floor. A major disadvantage associated with all of these prior art racks is the lack of easy portability when a barber moves from location to location or even from chair to chair in a barber shop. In addition, of these patents only the Smith patent provides some means for receiving and retaining barber accessories other than clippers. Smith achieves this with a shallow tray extending forwardly from the bottom edge of a wall-mounted board. Unfortunately, the tray projects out from the hanging rack, at least partially into the barber's work space where it can inadvertently be bumped resulting in injury to the barber and possible dislodging of the rack.

OBJECTS AND SUMMARY OF THE INVENTION

Accordingly, it is an object of the present invention to provide a portable case for retaining hair clippers and other barber's accessories that can be used to retain the clippers and accessories in a convenient and safe manner during a haircutting procedure.

It is another object of the invention to provide a portable case for retaining a plurality of hair clippers in a manner such that the electrical cords of the clippers can be maintained separated and protected from stress forces during a haircutting procedure and easily stowed when the case is being transported.

The aforesaid objects are achieved individually and in combination, and it is not intended that the present invention be construed as requiring two or more of the objects to be combined unless expressly required by the claims attached hereto.

The present invention is a carrying case for hair clippers and other barber's accessories having a main body and a cover hinged thereto. The hinged cover can be removed from the main body and separately stowed when the user is performing a haircutting procedure. The case has a generally rectangular configuration and one of the longer edges has defined therein a series of notches in which the proximal ends of respective electrical cords reside when the main body is deployed for use during a haircutting procedure. The interior portion of the main body is segmented into sections with the section adjacent the notched edge allocated to retaining the clipper. The notches are spaced sufficiently to permit respective clippers to be arrayed therein in spaced relation such that their respective cords can be folded and stored adjacent the clippers when the case is closed for transport. When the case is deployed for use, the parallel arrayed clippers are disposed with the bottoms of their handles adjacent respective notches and their cords extending out from the main body through those notches. If desired, clipper retaining section may be provided with dividers that subdivide the section into respective clipper sub-sections.

Other sections of the main body are sectioned off from the clipper section by dividers and contain accessories such as combs, brushes, scissors, spare clipper cutting heads and other accessories. The removable cover may be provided with a mirror on its interior surface to be used by the barber to permit the customer to view the results of the haircut.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
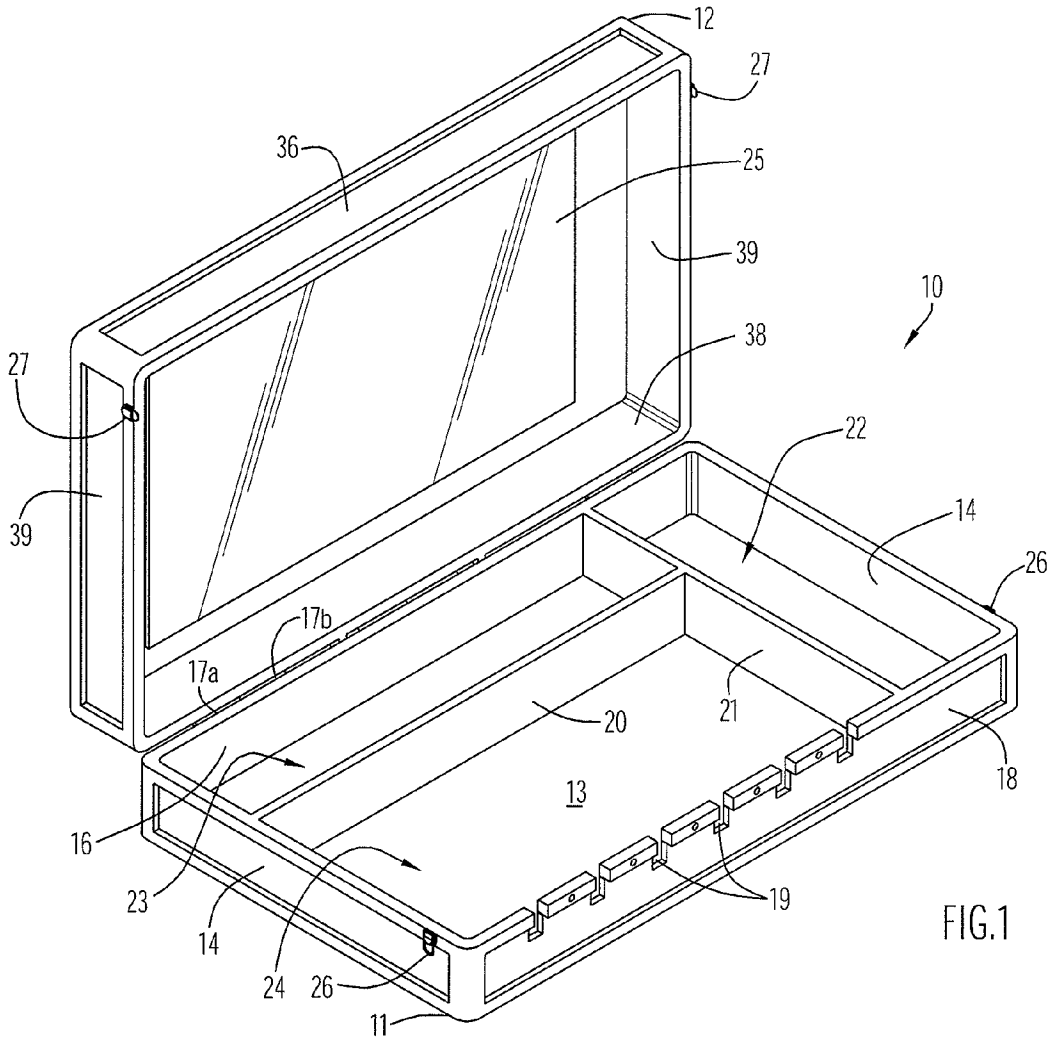
FIG. 1 is a front view in perspective of a preferred embodiment of a barber's carrying case of the present invention showing the case empty and in the open position and the cover attached.

A portable barber's case 10 of the present invention is illustrated in FIGS. 1-5 and includes a main body portion 11 and a lid or cover 12 configured generally rectangularly; however, it is to be understood that the present invention is not limited to rectangular cases since the principles of the invention apply to substantially any configuration. Main body 11 has a recessed rectangular bottom surface 13 peripherally surrounded on all four sides by a front wall 18, a rear wall 16 and opposing sidewalls 14 extending perpendicularly upward from surface 13. The tops of walls 14, 16 and 18 form a continuous edge 15 configured as a thin rectangular frame surrounding bottom surface 13. Rear wall 16 is pivotably secured to a corresponding edge of the cover 12 by means of pivotably engaged hinge members 17*a* and 17*b*, or the like, configured in a conventional manner as mating parts that are selectively separable to thereby permit the cover 12 to be entirely detached and removed from the main body 11. Front wall 18 has a plurality of spaced notches 19 defined in its exposed or top edge. The notches are sized to permit electrical cords of hair clippers to extend therethrough, and are typically but not necessarily ¼ inch wide and deep. The notches are preferably spaced uniformly by a distance somewhat greater than the width of a typical hair clipper to permit plural clippers to reside side by side with the bottoms of their handles adjacent bottom wall 18 and their electrical cords extending through respective notches 19. In one embodiment the spacing of the notches is 2½ inches on center. It should be noted, however, that this spacing may be slightly smaller (e.g., 2 inches) or as much as 3½ inches to assure space for the power cords during transport of the unit.

The space defined between the 14, 16 and 18 and bottom surface 13 is sub-divided into plural sections or compartments (three compartments in the illustrated embodiment) by means of 20 and 21. The partitions may be formed as part of the main body and permanently positioned, or they may be separate members that are selectively movable and removable. In the illustrated embodiment, partition 20 extends from one side wall 14 parallel to the front and rear walls and terminates at an intersection with partition 21. The latter extends between front wall 18 and rear wall 19 parallel to sidewalls 14. Partition 21 is located closer to the right side wall 14 than the left to define a first accessory retaining compartment 22 bounded by partition 21 and the near side wall 14 in its width or smaller dimension and by portions of front wall 18 and rear wall 16 in its longer dimension. The portion of compartment 22 residing along front wall 18 is not provided with notches 19 in its exposed edge. Partition 20 is located closer to rear wall 16 than to front wall 18 to define two compartments 23 and 24. Compartment 23 is bounded by portions of one sidewall 14 and partition 21 to terminate its longer dimension, and by partition 20 and a portion of rear wall 17 to terminate its shorter dimension. Compartment 24 is configured to receive and retain an array of hair clippers. Compartment 23 is configured to receive and retain other barber accessories. The upper edges of partitions 20, 21 in the preferred embodiment are co-planar with the upper edges 15 of the peripheral walls 14, 16 and 18 of the main body 11. Female latch members 26 are disposed on the outside surface of each of side walls 14 at locations spaced a short distance from front wall 18. Latch members 26 are adapted to receive and engage male latch members 27 on lid 12 in a conventional manner.

Cover or lid 12 has an interior surface onto which a mirror 25 is secured over a major portion of that surface. The mirrored surface is bounded by peripheral walls, namely front wall 36, rear wall 38 and opposed sidewalls 39 projecting downwardly and terminating in edges arranged to contact respective portion of edges 15 when the lid is pivoted downward about hinges 17*a* and 17*b* to close the case. Forwardly of hinge member 17*b* and located on each outer side wall of the cover are male latch members 27 positioned and configured to be received in and engaged by female latch members 26 on the main body 11.

The main body, cover and partitions may be made from wood, plastic or metal of characteristics consistent with the functions ascribed to them herein. A padding such as felt or thin foam may be used to line bottom surface 13, the peripheral walls and the partitions in one or more of the compartments.

Figure 4:
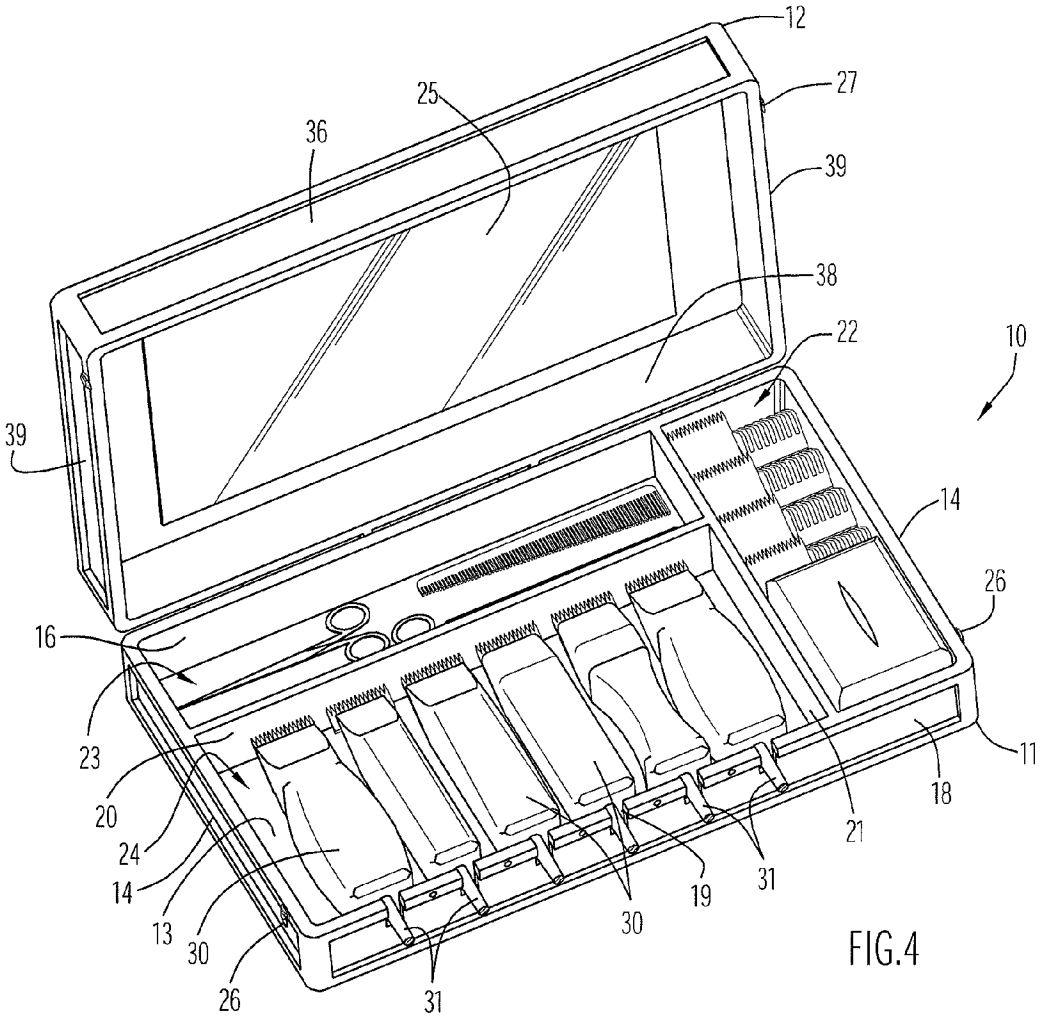
FIG. 4 is a front view in perspective of the barber's carrying case of FIG. 1 showing the case open and filled with hair clippers and other accessories.

As shown in FIG. 4, a plurality of hair clippers 30 can be placed side-by-side in compartment 24. The hair clippers are conventional and typically are of different types to effect different cuts, but all are typified by having a body which serves as a handle or grip which the barber places in one hand when cutting hair. One end (i.e., the distal or cutting end) of the body has a cutter mounted thereon made up of electrically driven cutting blades. The opposite or proximal end of the body has an electrical cord 31 extending therefrom, the cord terminating in a conventional plug (not shown) adapted to be received in a conventional wall-mounted socket which supplies the electrical voltage and current required to drive a motor housed in the clipper body. When the case 10 is deployed for use during a haircut, the bottom surface of main body 11 is placed on a flat support surface such as a barber's counter. Rubber or plastic friction pads may be secured to the bottom surface of the main body to prevent it from slipping on the support surface. Compartment or section 24 is configured to receive a plurality of different hair clippers 30 arranged side-by-side with the proximal ends of their handles adjacent respective notches 19 such that the electrical cord 31 for each clipper can be positioned in and extend through a respective notch 19 to the outside of the main body where their distal plugs (not shown) can be inserted into respective electrical sockets. The notches 19 maintain the cords 31 in spaced relation and thereby minimize entangling between the cords. In addition, the notches retain the cords 31 and protect them against breakage due to stress force during use.

The space in compartment 24 is sized and configured to permit the cords of the various clippers 30 to be curled and be placed adjacent a respective clipper, or wound about the clipper, when the unit is closed and ready to be stored or transported.

Compartment 23 is configured to receive a variety of combs and/or scissors. Compartment 22 is configured to receive spare clipper cutting heads, brushes and other accessories such as a tissue container.

Figure 5:
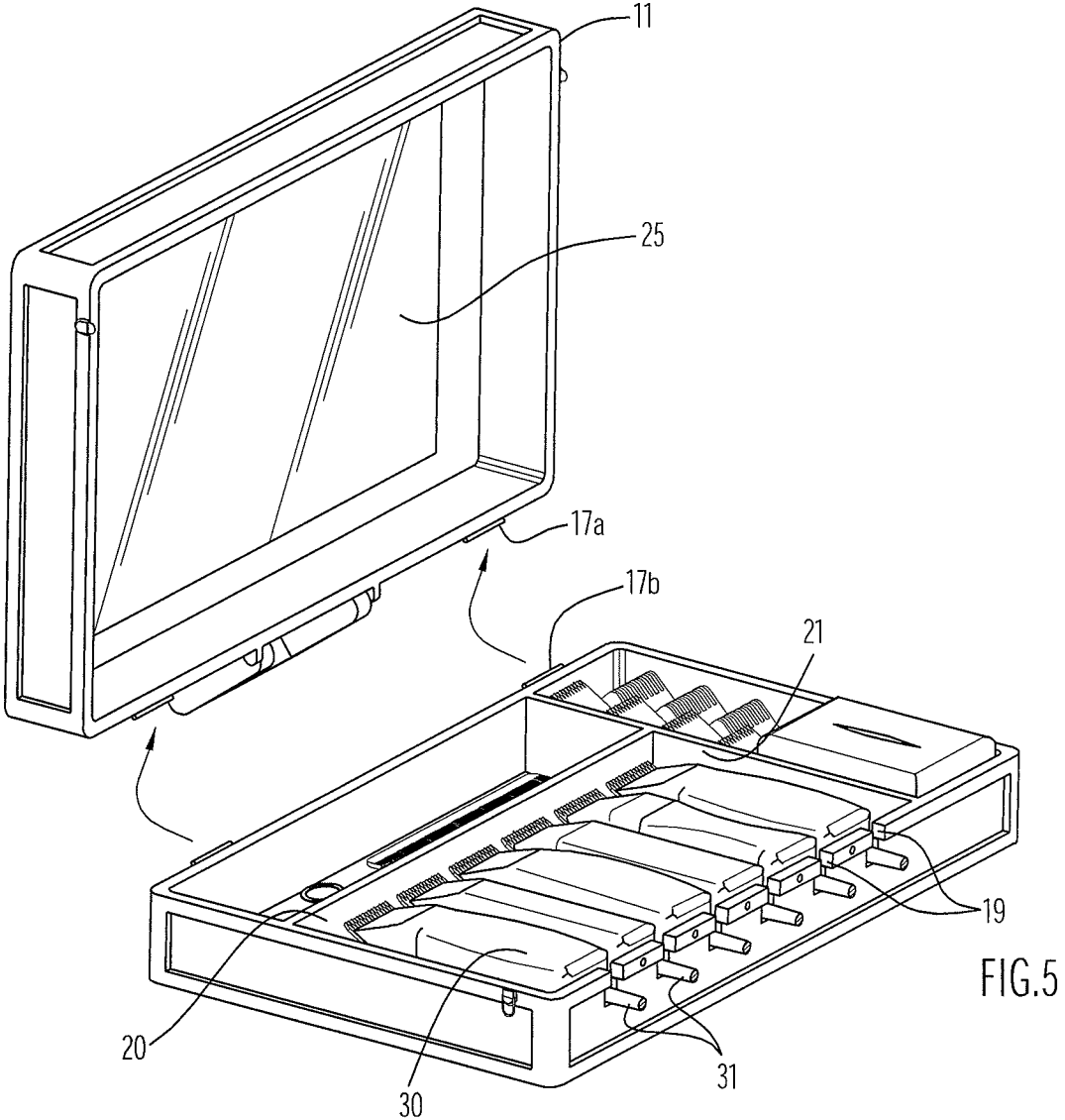
FIG. 5 is a front view in perspective of the barber's carrying case of FIG. 1 showing the case open, filled with hair clippers and other accessories, and with the cover detached from the main body of the case.

The unit may be used during a hair cut with the lid 12 open but secured to main body 11, as shown in FIG. 4, or the lid may be entirely removed, as shown in FIG. 5.

Figure 6:
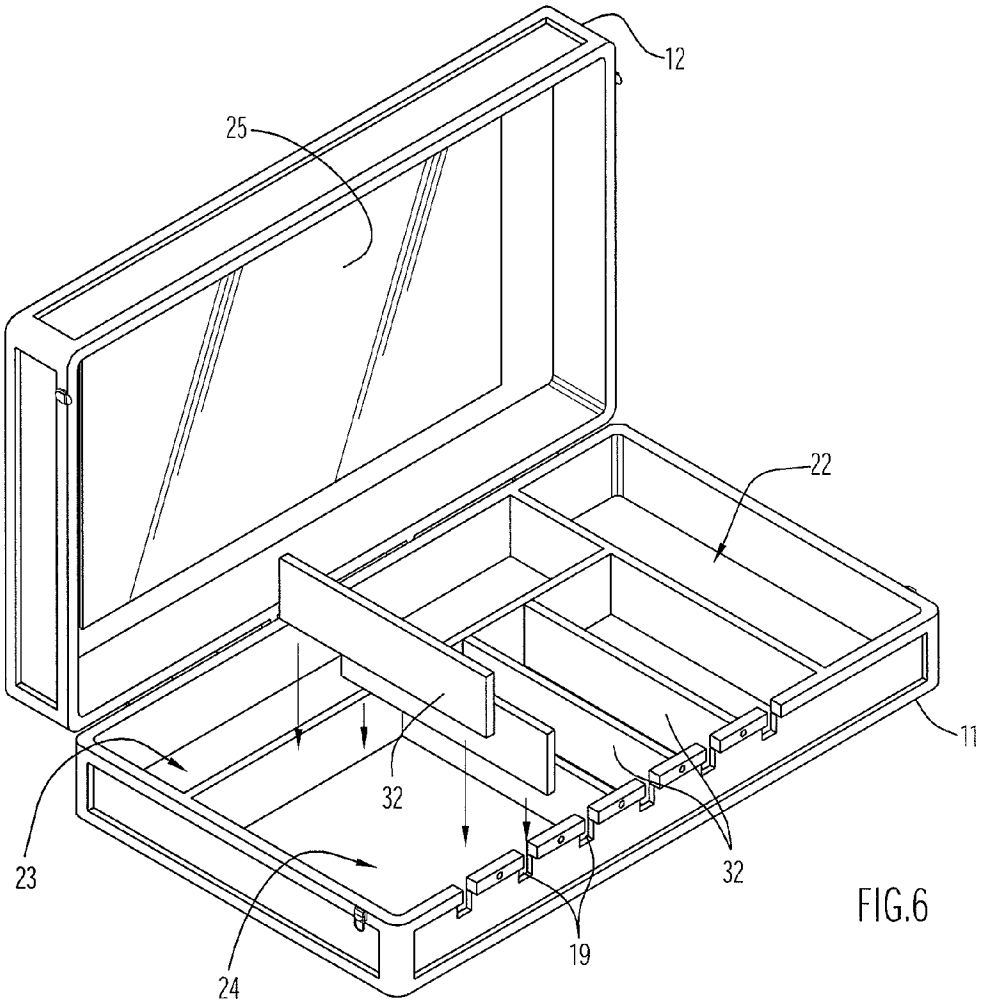
FIG. 6 is a partially exploded front view in perspective of a second preferred embodiment of a barber's carrying case of the present invention showing the case empty and in the open position and the cover attached and further showing partitions for sub-dividing the clipper-retaining section of the case onto sub-sections for retaining respective individual clippers.

As shown in FIG. 6, compartment 24 may be sub-divided into a plurality of sub-sections by additional dividers 32 extending parallel to one another in spaced relation between partition 20 and front wall 18. In use, the thusly formed sub-section receives respective clippers to thereby enhance the clipper organizational feature of the present invention. Partitions 32 may be formed with main body 11 to be a permanent part thereof, or they may be separate members that can be selectively inserted and positioned by the end user.

Figure 2:
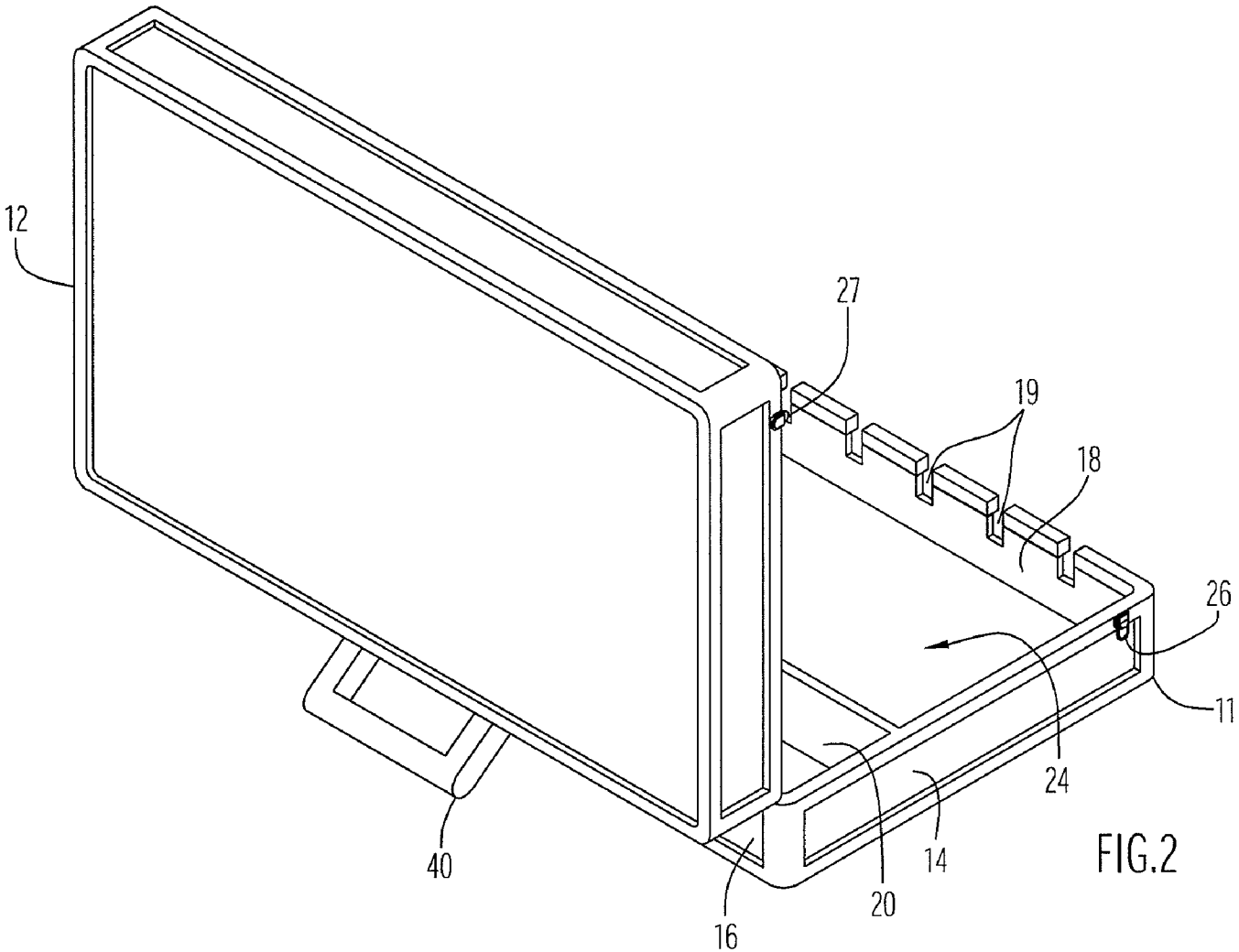
FIG. 2 is a rear view in perspective of the barber's carrying case of FIG. 1 showing the case in the open position and the cover attached.
Figure 3:
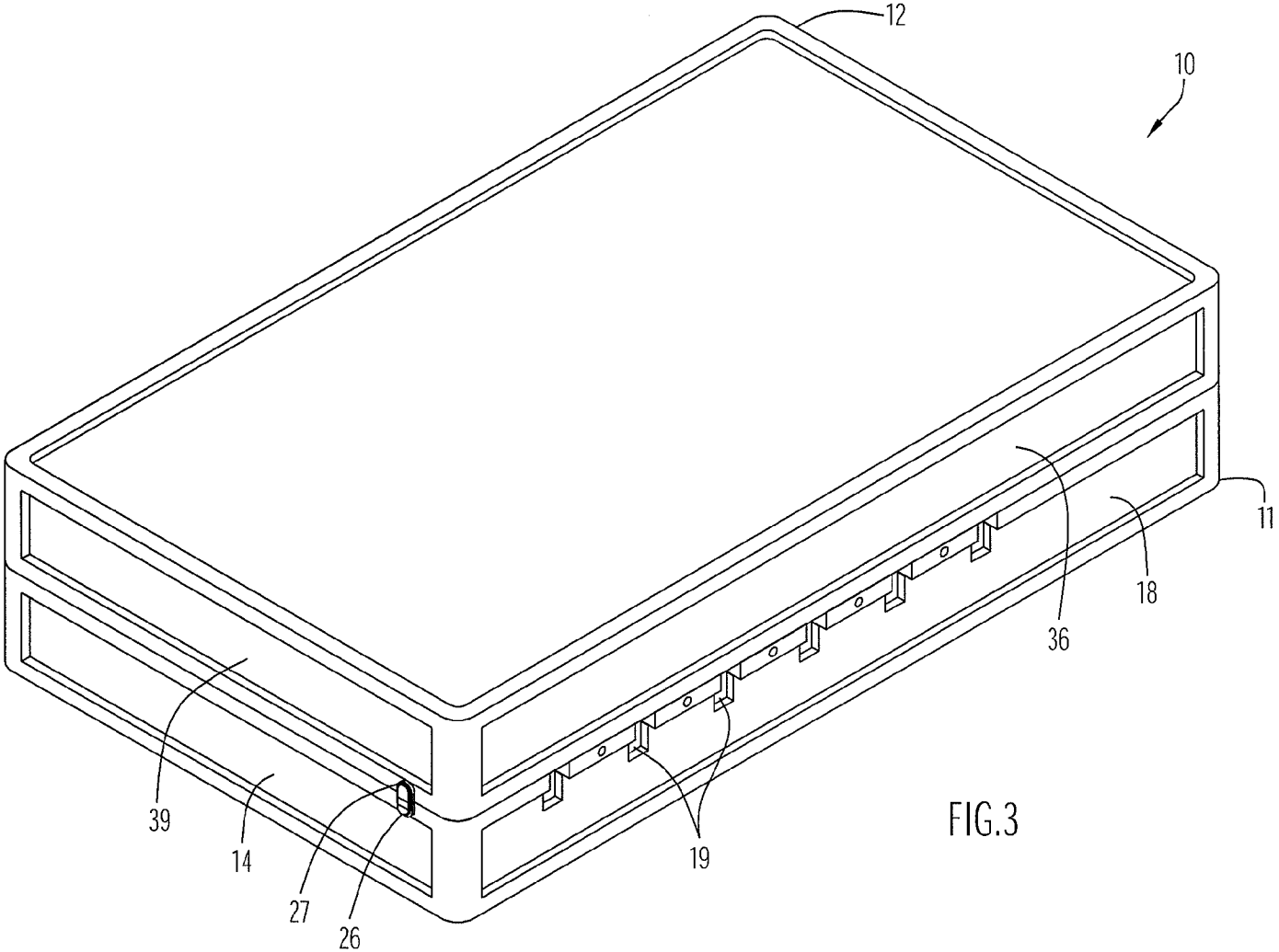
FIG. 3 is a view in perspective of the carrying case of FIG. 1 showing the case in the closed position.

As best illustrated in FIG. 2, a conventional carry case handle 40 may be secured to the outer surface of rear wall 16, or to the corresponding wall of lid 12, or to both to facilitate carrying of the case during transport. Alternatively, the handle may be located on the front wall(s) of the unit.

The invention affords barbers a number of advantages. For example, because the electric cord is retained in an open top notch or slot that is substantially fitted to the cord (i.e., the width of the notch is only slightly greater than the cord diameter), the electric cord is maintained extended away from the hair clipper in a generally straight direction thereby avoiding the extreme bending of the cord at the hair clipper. This is true especially when the electric outlet into which the hair clipper cord is plugged is located below the top of a barber's counter on which body member 11 rests.

In addition, the case of the present invention may accommodate a plurality of electric hair clippers in a ready-to-use position without the disadvantages encountered by the prior art structures and methods. A hair clipper is placed in compartment 24 with a notch 19 receiving the electric cord to help retain the hair clipper in a relatively fixed position in the compartment. As disclosed in FIG. 6, partitions 32 may be employed to further aid this function.

The case of the invention, when supported on the barber's counter as described, renders all of the retained hair clippers visible and accessible to the barber. When any one of the retained hair clippers is to be used, the barber simply grasps the body of that clipper and removes it from its position in compartment 24, lifting with it the cord through the open top of the notch 19 in which the cord resides.

Another advantage of the present invention is that the clippers and other accessories are presented for use by the barber in a case that can be used to transport the clippers or accessories from location to location, thereby saving the barber significant time in preparing for such transport and in arraying the clippers and accessories after such transport.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of displaying and storing a hair clipper, the method comprising:

(a) providing a first clipper and a second clipper, each clipper comprising:

a body defining a longitudinal axis, the body having a cutting end and a corded end, and an electric power cord extending distally from the corded end of the body, the power cord having a proximal end coupled to the hair clipper and a distal end including an electrical plug;

(b) providing a container including:

a main body comprising:

a bottom wall having:

a first side to contact a supporting surface and a second side opposed to the first side operable to support the hair clippers, and a peripheral wall extending distally from the bottom wall to define a display area along the second side, the peripheral wall including a first notch and a second notch formed into the peripheral wall;

(c) placing the first clipper within the display area;

(d) placing the second clipper within the display area such that the second clipper is oriented generally parallel to the first clipper;

(e) inserting the power cord of the first clipper into the first notch such that it extends through the peripheral wall of the main body; and (f) inserting the power cord of the second clipper into the second notch such that the cord extends through the peripheral wall of the main body.

2. The method according to claim 1, wherein:

the container further comprises a cover pivotally coupled to the main body, the cover including:

a top wall having an interior surface and an exterior surface, and a peripheral wall extending distally from the top wall;

the method further comprises (g) pivoting the cover from an opened container position, in which the plurality of clippers may be selectively removed from the display area, to a closed container position, in which the plurality of clippers are secured within the container; and the notches permit the power cords to extend through the peripheral wall of the main body in the opened and closed container positions.

3. The method according to claim 2, wherein:

the cover is selectively detachable from the main body; and the method further comprises (h) selectively detaching the cover from the main body.

4. The method according to claim 2, wherein:

the container further comprises a handle and a latch operable to secure the container in the closed position; and the method further comprises (h) securing the container in the closed position via the latch and (i) transporting the container via the handle.

5. The method according to claim 1, wherein:

(c) comprises (c.1) orienting the first clipper within the display area such that the longitudinal axis of the clipper body is generally parallel to the bottom wall and the corded end of the clipper body is positioned adjacent the first notch; and (d) comprises (d.1) orienting the second clipper within the display area such that the longitudinal axis of the clipper body is generally parallel to the bottom wall and the corded end of the clipper body is positioned adjacent the second notch.

6. The method according to claim 1, wherein:

(c) comprises (c.1) orienting the first clipper within the display area such that the longitudinal axis of the clipper body generally aligns with the first notch formed into the peripheral wall of the main body; and (d) comprises (d.1) orienting the first clipper within the display area such that the longitudinal axis of the clipper body generally aligns with the first notch formed into the peripheral wall of the main body.

7. The method according to claim 6, wherein:

(c) further comprises (c.2) orienting the corded end of the first clipper proximate the first notch; and (d) further comprises (d.2) orienting the corded end of the second clipper proximate the second notch.

8. The method according to claim 1, wherein:

the container further comprises a partition dividing the display area into a first compartment and a second compartment;

(c) comprises (c.1) placing the first clipper within the first compartment;

(d) comprises (d.1) placing the second clipper within the first compartment such that the second clipper is oriented generally parallel to the first clipper; and the method further comprises (g) placing at least one barber accessory in the second compartment.

9. The method according to claim 1 further comprising:

(h) orienting the cover in the opened container position; and (i) selectively removing the first clipper from the container and removing the power cord from the first notch.

10. The method according to claim 1 further comprising:

(h) orienting the cover in the closed container position; and (i) connecting the electrical plug of the first clipper to an electrical outlet.

11. The method according to claim 1 further comprising:

(h) orienting the cover in the opened container position;

(i) removing the electrical cord of the first clipper from the first notch;

(j) removing the electrical cord of the second clipper from the second notch;

(k) placing the electrical cords within the display area; and (l) orienting the cover in the closed position.

12. A system for displaying, storing, and transporting a plurality of electrically driven hair clippers, the system comprising:

a hair clipper including:

a body defining a longitudinal axis, the body having a cutting end and a corded end, and an electrical power cord extending distally from the corded end of the body, the power cord having a proximal end coupled to the hair clipper and a distal end including an electrical plug; and a container comprising:

a main body including:

a bottom wall having a first side to contact a supporting surface and an opposed second side to support the hair clipper, a peripheral wall extending distally from the bottom wall to define a display area along the second side of the bottom wall, and at least one open-top notch formed into the peripheral wall of the main body, wherein the notch is configured to receive the power cord therein, and a cover including:

a lid wall having an interior surface and an exterior surface, and a peripheral wall extending distally from the lid wall, wherein the cover is pivotally coupled to the main body such that the cover pivots from an opened container position to a closed container position, wherein the at least one notch is operable to retain the power cord of the hair clipper within the notch in both the opened container position and the container cover position.

13. The system of claim 12, wherein the notch is substantially fitted to the power cord.

14. The system of claim 12, wherein:

the at least one notch comprises a plurality of notches;

the at least one hair clipper comprises a plurality of hair clippers arranged in side-by-side relation; and the plurality of notches maintain respective power cords of the hair clippers in spaced relation.

15. The system of claim 14, wherein:

the main body peripheral wall comprises a front wall portion, a rear wall portion, and side wall portions disposed between the front and rear wall portions;

the main body peripheral wall includes a front wall portion, a rear wall portion, and side wall portions disposed between the front and rear wall portions; and the notches are disposed along the frontal wall portion of the main body.

16. The system of claim 15, wherein the cover is pivotally coupled to the main body via a hinge assembly disposed along the respective rear wall portions of the main body and the cover.

17. The system of claim 12, wherein cover is selectively detachable from the main body.

18. The system of claim 12, wherein the cover further comprises a mirror secured on the interior surface of the cover to enable viewing in the open container position.

19. The system of claim 12, wherein:

the container further comprises at least one partition dividing the display area into a first compartment and a second compartment;

the first compartment is configured to receive a plurality the hair clippers in side-by-side relation; and the second compartment is configured to receive barber accessories selected from the group consisting of a comb, a brush, and scissors.

20. The system of claim 12, wherein the display area orients the clipper such that the longitudinal axis of the clipper body generally aligns with the notch formed into the peripheral wall of the main body.

21. The system of claim 20, wherein:

the clipper is oriented in the case such that the corded end of the clipper body is positioned adjacent the notch; and the clipper cord passes through the peripheral wall via the notch such that the peripheral end of the cord extends away from the hair clipper in generally straight direction thereby avoiding extreme bending of the cord in the area proximate the hair clipper.

* * * * *